US006546570B1

(12) United States Patent
Eidson

(10) Patent No.: US 6,546,570 B1
(45) Date of Patent: Apr. 15, 2003

(54) SYSTEM TO CONVERT MASSAGE TABLES TO WET TABLES AND VICHY SHOWERS

(76) Inventor: Richard Eidson, 205 W. Burlington Ave., Suite 102, Fairfield, IA (US) 52556

( * ) Notice: Subject to any disclaimer, the term of this patent is extended or adjusted under 35 U.S.C. 154(b) by 0 days.

(21) Appl. No.: 09/845,940

(22) Filed: Apr. 30, 2001

Related U.S. Application Data

(60) Provisional application No. 60/200,582, filed on Apr. 28, 2000.

(51) Int. Cl.[7] ..... A61H 33/00
(52) U.S. Cl. ..... 4/546; 4/585
(58) Field of Search ..... 4/546, 548, 559, 4/571.1, 585

(56) References Cited

U.S. PATENT DOCUMENTS 3,800,336 A * 4/1974 Hoxeng ..... 4/587
4,485,502 A * 12/1984 Marcanio ..... 4/585
5,285,539 A * 2/1994 Anderson et al. ..... 4/564.1
5,909,970 A * 6/1999 Velozquez ..... 4/585

* cited by examiner

*Primary Examiner*—Charles E. Phillips
(74) *Attorney, Agent, or Firm*—Sheldon H. Parker

(57) ABSTRACT

The disclosed system enables the conversion of a massage table to a hydrotherapy wet-table through use of a frame. The frame consists of a horizontal foot panel, connected to a drain system, and a foot upright affixed to the foot brace. A pair of prongs extend from the foot brace to be received by holes within the table. The head panel also has a substantially horizontal head brace, with a head upright affixed to the head brace. A head support is placed within the table to provide support for the head panel. Sidepieces are connected to the foot and head uprights to complete the frame. A waterproof sheet covers the table and frame and is secured by releasable attachments members. The system can also have an overhead U-shaped frame formed from a pair of frame walls rotatably attached to the sidepieces. A waterproof covering can be placed over the frame walls and top frame to maintain the water within the confines of the hydrotherapy table.

18 Claims, 16 Drawing Sheets

SYSTEM TO CONVERT MASSAGE TABLES TO WET TABLES AND VICHY SHOWERS

This application claims the benefit of No. 60/200,582, filed Apr. 28, 2000.

BACKGROUND OF THE INVENTION

1. Field of the Invention

The invention relates to a portable conversion system to convert massage tables into hrydo wet tables and Vichy showers.

2. Description of the Prior Art

Day spas, destination spas, hair salons, health and fitness centers are now offering spa treatments given by professional massage therapists and estheticians that require a treatment table that allows water to be brought to the client on the treatment table to either wet the skin, rinse the skin or massage the skin. Spa treatments are also being offered that require several shower heads to be placed above the client on the massage table for the purpose a hydro pressure massage and to rinse the skin. There are currently available for this purpose wet-tables that are made out of molded plastic with a waterproof pad that the client lays on. Most of these tables are designed for use only in a wet-room, which is a tiled room with a floor drain so that the water drains from the table to the floor and to a floor drain. Wet-rooms are very expensive to construct with a minimum investment of $10, 000 and most buildings are leased by the spa. Wet-rooms are also less comfortable than normal treatment rooms and are more likely to have accidents as a result of slipping on a wet floor.

The rooms required for prior art tables are expensive to build and are difficult to retrofit due to the plumbing requirements. A standard massage table is also required as a normal function of the business, thereby increasing the cost to the professional. Most spas are privately owned business by owners who are estheticians or massage therapists that have limited capital to invest in equipment. They also have limited capital to invest in major facility renovations on buildings which are leased for use as a spa for a limited period of time. The day spa and destination spa is a rapidly growing industry with more than 100,000 licensed massage therapist in the USA and more than 18,000 in Florida alone. According to a recent study published in Day Spa Magazine, February 2000, 93% of day spas offer massage treatments, 89% offer body scrubs which can be done best on a wet-table and 25% offer other forms of hydrotherapy treatments. According to the survey, 10% of existing spas plan to add hydrotherapy systems designed to provide treatments that could be done with the disclosed system.

The disclosed system overcomes the foregoing problems by affordably transforming any conventional massage table into a hydro wet-table. Because the disclosed system allows treatments to be done in a normal treatment room and does not require a wet-room, spas that want to do hydro wet-table treatments but cannot afford a wet-room will now have the option to offer hydro wet-table treatments.

The disclosed system also improves hygiene compared to conventional wet-tables where the client lays on a foam pad, by using a vinyl cloth that covers the massage table surface and then another piece of comfortable, washable cloth is placed on the table that the client lays on. This additional cloth is machined washed after each treatment with a disinfectant for maximum hygiene.

SUMMARY OF THE INVENTION

The disclosed system enables a conventional massage table to be used both as a massage table and a hydro wet-table at the same time, eliminating the need for specially built tables and rooms by permitting the hydro wet-table treatments to be done in a normal treatment room. The client benefits from the full comfort of a massage table for massage treatments and hydro wet-table treatments and the client does not need to leave the treatment table during a series of massage and hydro wet-table treatments. This means that more treatments can be done in one room, which improves the profitability of the room space by making it more multi-purpose. On other wet-tables, the client is laying on an uncomfortable pad during the wet-table treatment.

The disclosed system enables the conversion of a massage table to a hydrotherapy wet-table through use of a frame dimensioned to have an interior perimeter slightly greater than the massage table exterior perimeter. The frame consists of a foot panel having a horizontal foot brace and a foot upright affixed to the foot brace at approximately a right angle. A pair of prongs extend from the foot brace and are dimensioned to be received by holes within a first end of the massage table. The frame also has a head panel having a substantially horizontal head brace, with a head upright affixed to the head brace at approximately a right angle. Preferably the head brace incorporates a head hole that extends through the head brace and aligning with a head hole in the massage table to enable a user to lie face down.

A head support, consisting of a support panel and a pair of prongs is placed within a second end of the massage table to provide support for the head panel. The head support can be dimensioned to raise the head panel slightly to run water down toward the foot of the table. Sidepieces are connected to the foot and head uprights to complete the frame. Preferably the head and foot uprights are slightly shorter than the foot and head braces, enabling the sidepieces to rest on the braces. In an alternate embodiment, the sidepieces can be two or more lengths to enable the sidepieces to be folded for additional portability.

A waterproof sheet is used to cover the massage table and frame and is maintained in place by releasable attachments members. A cover cloth is preferably placed over the waterproof liner to provide for user comfort.

To prevent water build up, a drain hole is placed within the foot brace, and connected to a drain system. In one embodiment the drain system is a water recycling system comprising a pump, a hand held shower and a retaining vessel to receive water from the wet-table. The pump pumps water from the retaining vessel to the hand held shower, thereby circulating said water. Preferably the recycling system has a heater within said retaining vessel to maintain the water at a predetermined temperature.

The system can also have an overhead U-shaped frame formed from a pair of frame walls rotatably attached to the sidepieces. Both of the frame walls have an attachment base having a length less than the length of the sidepieces and a parallel horizontal support with a length about equal to the attachment base. At least two vertical supports each have a first end attached to the attachment base and a second end attached to the horizontal support. One of the frame walls has frame receiving members positioned along the horizontal support A top frame has at least a pair of supports, each of which has rotatable attachment members at a first end and interlocking members at a second end. The interlocking members being positioned to be received by the frame receiving members. A brace extends between the supports proximate the interlocking members. An appliance bar extends between the supports to enable at least one appliance to be positioned over a user. In one embodiment on end of the appliance bar is connected to a water source and sealed at a second end with multiple showerheads arranged along the bar. Alternatively heat lamps, fans or other appliances can be attached to the bar. A waterproof covering is preferably placed over the frame walls and top frame to maintain the water within the confines of the hydrotherapy table. The ends of the canopy structure can also be covered.

In the embodiment incorporating the canopy, the client is completely covered by the hydro wet-table canopy, blocking the client's body from view by the therapist, with the exception of the head. This provides complete privacy, as well as maintains the temperature inside at approximately 90 degrees. On conventional wet-tables the client is in full view of the therapist and because the room temperature is approximately 70 degrees, the client often gets cold during the treatment.

The disclosed system is more hygienic than current hydro wet-tables by providing a vinyl cloth that covers the massage table surface and then another piece of comfortable, washable cloth is placed on the table that the client lays on. This cloth is machined washed after each treatment with a disinfectant for maximum hygiene. The disclosed drain system connects to an existing drain in the room or a drain can be brought to the wall of the room from water lines in the building. The hydro wet table conversion kit also eliminates the need for a wet-room as all the water during the treatment drains to the back of the table and to a drain and does not get on the floor.

The invention can also be used in a residential setting for persons who want spa treatments including hydrotherapy treatments in their home. They can have a trained massage therapist or esthetician come to their residence to perform treatments, which is already a common practice. The invention gives them the option to create a spa in their own home and when the room is needed for other purposes, the system can be easily disassembled and stored.

BRIEF DESCRIPTION OF THE DRAWINGS

The advantages of the instant disclosure will become more apparent when read with the specification and the drawings, wherein.

DETAILED DESCRIPTION OF THE INVENTION

The disclosed system enables a standard massage table to be converted to a wet-table and/or Vichy shower. Wet-tables are used in the field of hydrotherapy to allow water to be brought to the client on the treatment table, usually in the form of a handheld shower and/or showerheads above the person lying on the treatment table. The purpose is to bring water to the skin, massage the skin with water under pressure, rinsing the skin of spa products such as massage oil, medicinal mud, seaweed, etc. The disclosed system transforms any conventional massage table, portable or stationary, to a wet-table table with hydrotherapy capabilities that can be used in a normal treatment room, eliminating the need for a tiled wet room.

Figure 1:
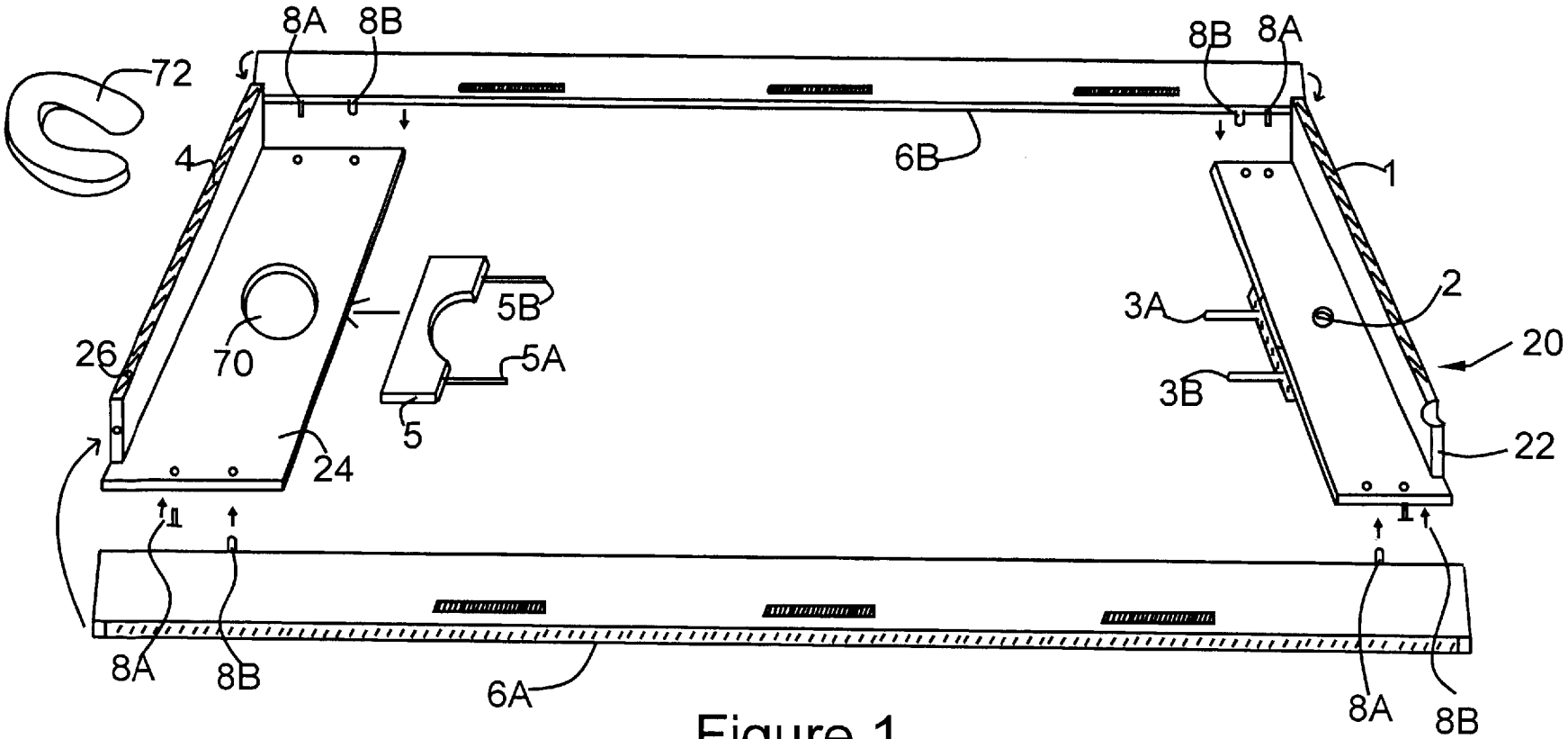
FIG. 1 is a perspective view of the unassembled conversion kit of the disclosed invention.

The table conversion system consists of a frame that has five separate pieces. The frame, illustrated in FIG. 1, can be manufactured from a durable wood, such as oak, plastic, lightweight metal or other applicable, water resistant material. The foot panel assembly 1 is slightly longer than the width of the massage table and comprises a foot brace 20 and foot upright 22. In the illustrated embodiment, the foot brace 20 has a greater length than the foot upright 22 to receive the sidepieces 6*a* and 6*b*. This enables the sidepieces 6*a* and 6*b* to rest on the foot brace 20 for support, as well as maintaining a flush outer surface. A hole 2 is placed in the center of the foot brace 20 to receive the drain (not shown). The foot brace 20 and foot upright 22 are at right angles to one another and secured together through means applicable to the materials used. Since the frame could be exposed to water, a sealant should be used to prevent water leakage at the juncture of the brace 20 and upright 22. On the bottom of the foot brace 20 two wooden dowels 3*a*, 3*b* are attached, extending toward the head panel assembly 4. The dowels 3*a*, 3*b* will be inserted into the two holes that come with all massage tables 30*a*, 30*b* (FIG. 8) at both the head and foot end of the massage table. These holes are placed in all conventional massage tables for the purpose of installing a headrest or foot rest, as described further herein in conjunction with FIG. 8. The head panel assembly 4 is slightly longer than the width of the massage table and is generally equal to the length of the foot panel assembly 1. The head brace 24 and head upright 26 are at right angles to one another and dimensioned to enable the sidepieces 6*a* and 6*b* to rest on the head brace 24. A head panel support 5 is used to support the head panel assembly 4 at the head of the table. The dowels 5*a* and 5*b* of the head panel support 5 are dimensioned to be received by the holes at the head of the table, thereby causing the head panel support 5 to extend parallel to the ground. The head brace 24 is then supported on the head panel support 5. A face hole 70, approximately 6" in diameter, is preferably centered in the head brace 24 to enable use of the head rest 72 that comes with the system.

The headrest 72 is used when it necessary for the client lay face down on the massage table for long periods of time.

A pair of side pieces 6*a* and 6*b* extend the length of the table and are secured at right angles to the head panel 4 and the foot panel 1. As stated heretofore, the sidepieces 6*a* and 6*b* rest, and are secured to, on the foot brace 20 and the head brace 24. In an alternate embodiment, the sidepieces 6*a*, 6*b*, can be divided into two equal pieces and attached with a hinge so that they can fold into lengths of 3'8". This would allow a therapist to put the entire kit into a duffel bag a transport it along with a portable massage table easily by car to any location.

An example of typical dimensioning for the frame would be a foot panel having a length of about 27" to 35", about 5" wide and about 4" high. The head panel would have a length about 27" to 35", 11" wide and 4" high. The sides pieces are generally about 89" long, 4" high and ¾" in width. The frame can be secured together through use of dowels, screws, adhesives, or other applicable materials. These dimensions can easily be altered to adapt to any table or surface based upon the teachings herein.

Figure 2:
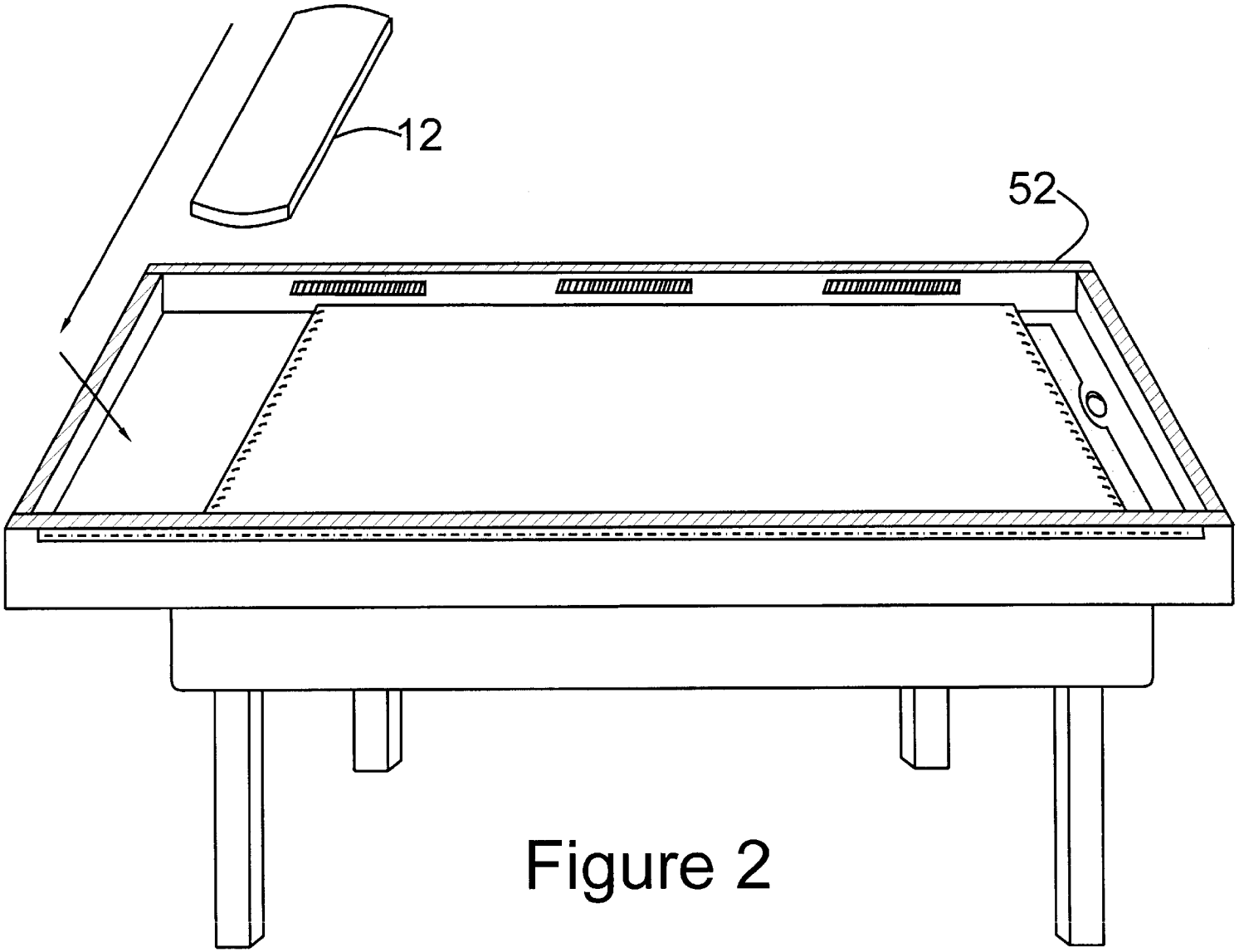
FIG. 2 is an exploded perspective view of the partially assembled conversion kit mounted on a table.
Figure 8:
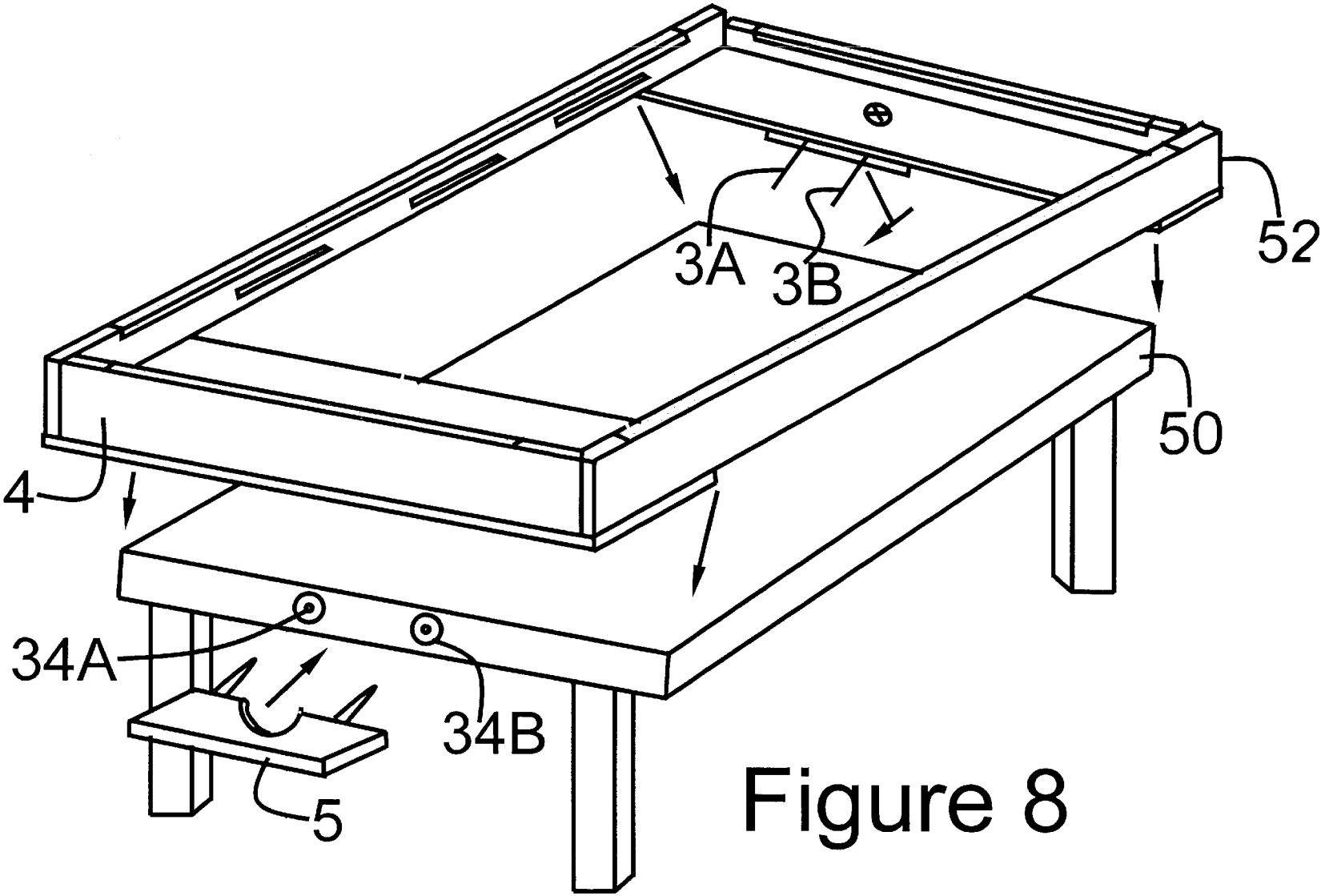
FIG. 8 is an exploded view of the assembled table conversion system and massage table.
Figure 9:
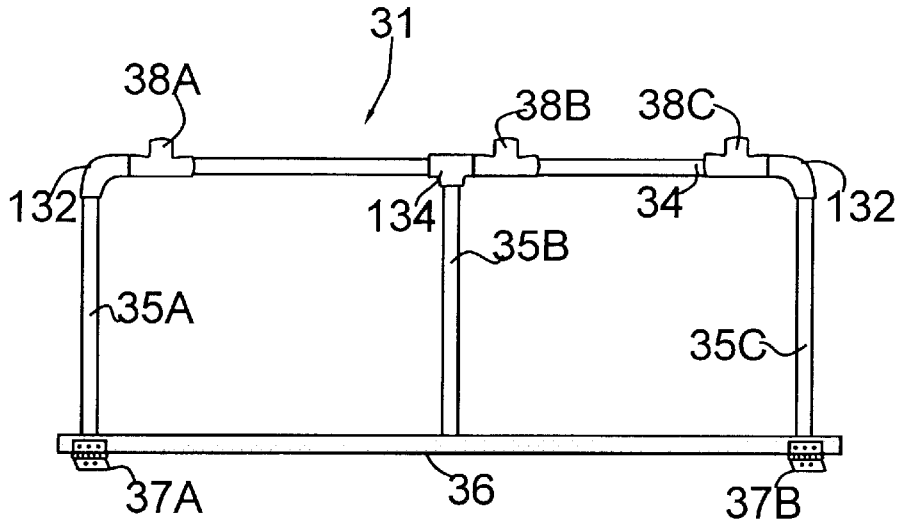
FIG. 9 is a side view of one of the Vichy shower side panels.
Figure 10:
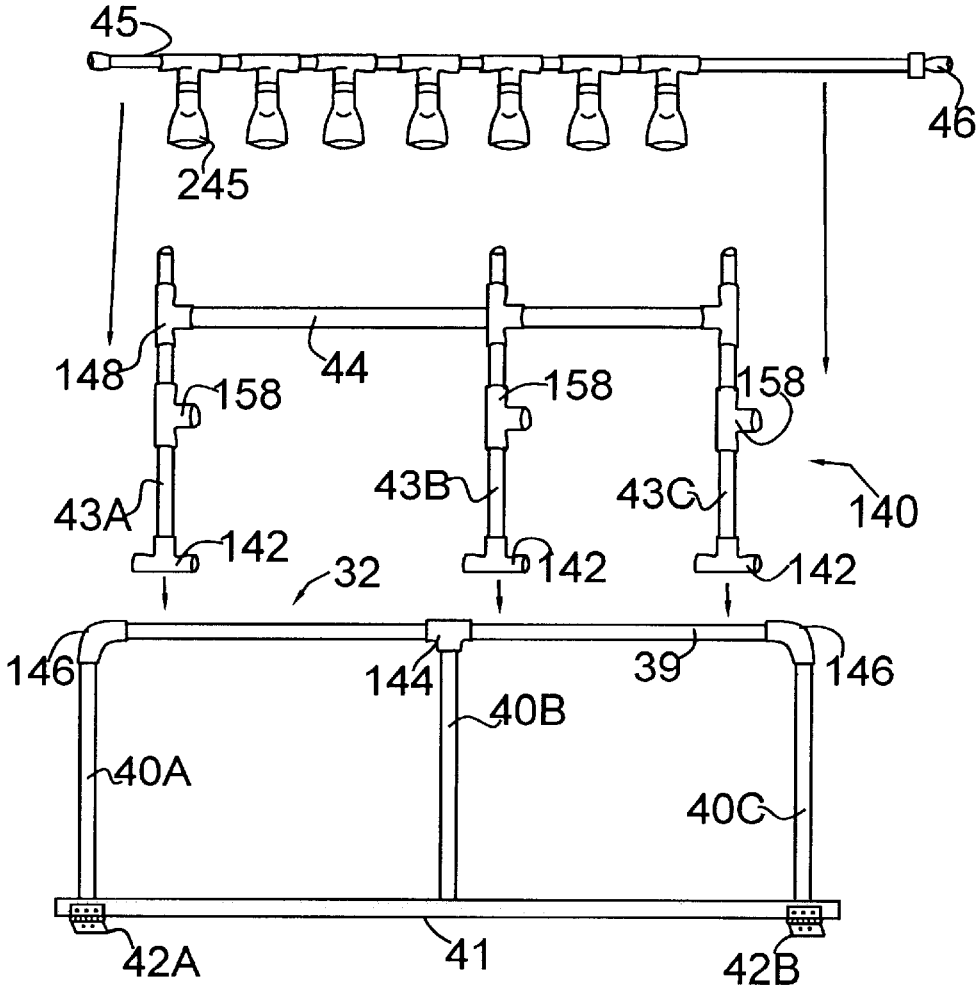
FIG. 10 is an exploded side view of the second side panel with the top and shower heads.

To assemble the frame 52 each of the side pieces 6*a* and 6*b* is attached to the foot brace 1 with the head piece 4 then being connected to other end of the side pieces 6*a* and 6*b*. To attach the assembled frame 52 to the massage table 50, as illustrated in FIG. 8, the head support piece 5 is inserted into the two holes 34*a* and 34*b*, at the head end of the massage table 50. Then the assembled frame is lifted above the table and the two dowels 3*a* and 3*b* are inserted into the two holes 30*a* and 30*b* in the massage table at the foot end. The headpiece 4 is then laid on top of head support piece 5. The frame is now attached to the massage table. Once the assembled frame 52 is placed on the table, the head support cushion 12 is placed on the head piece 5, as illustrated in FIG. 2, to prevent the client's head from coming in contact with the hard frame.

Figure 3:
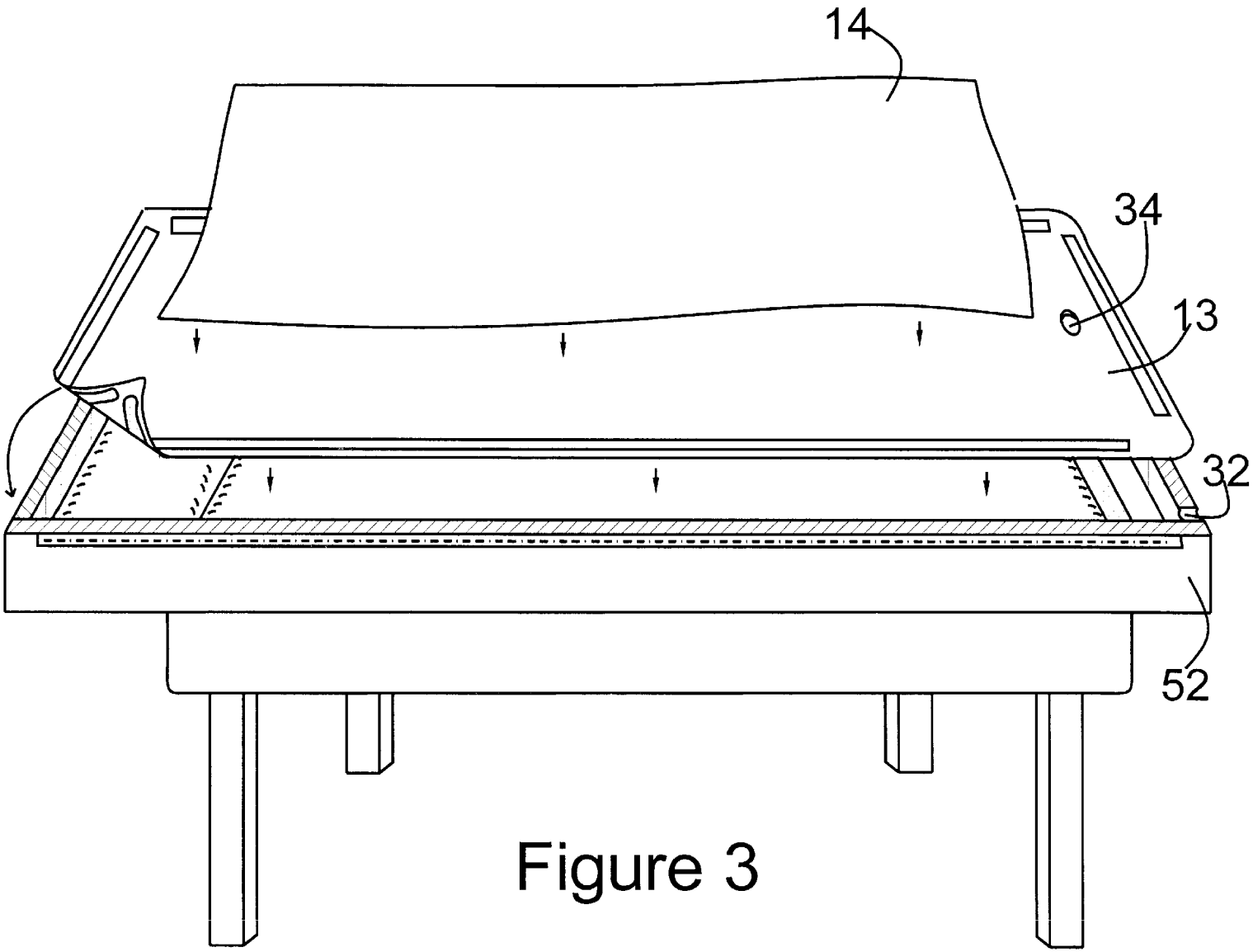
FIG. 3 is an exploded view of the covers used with the disclosed invention.
Figure 4:
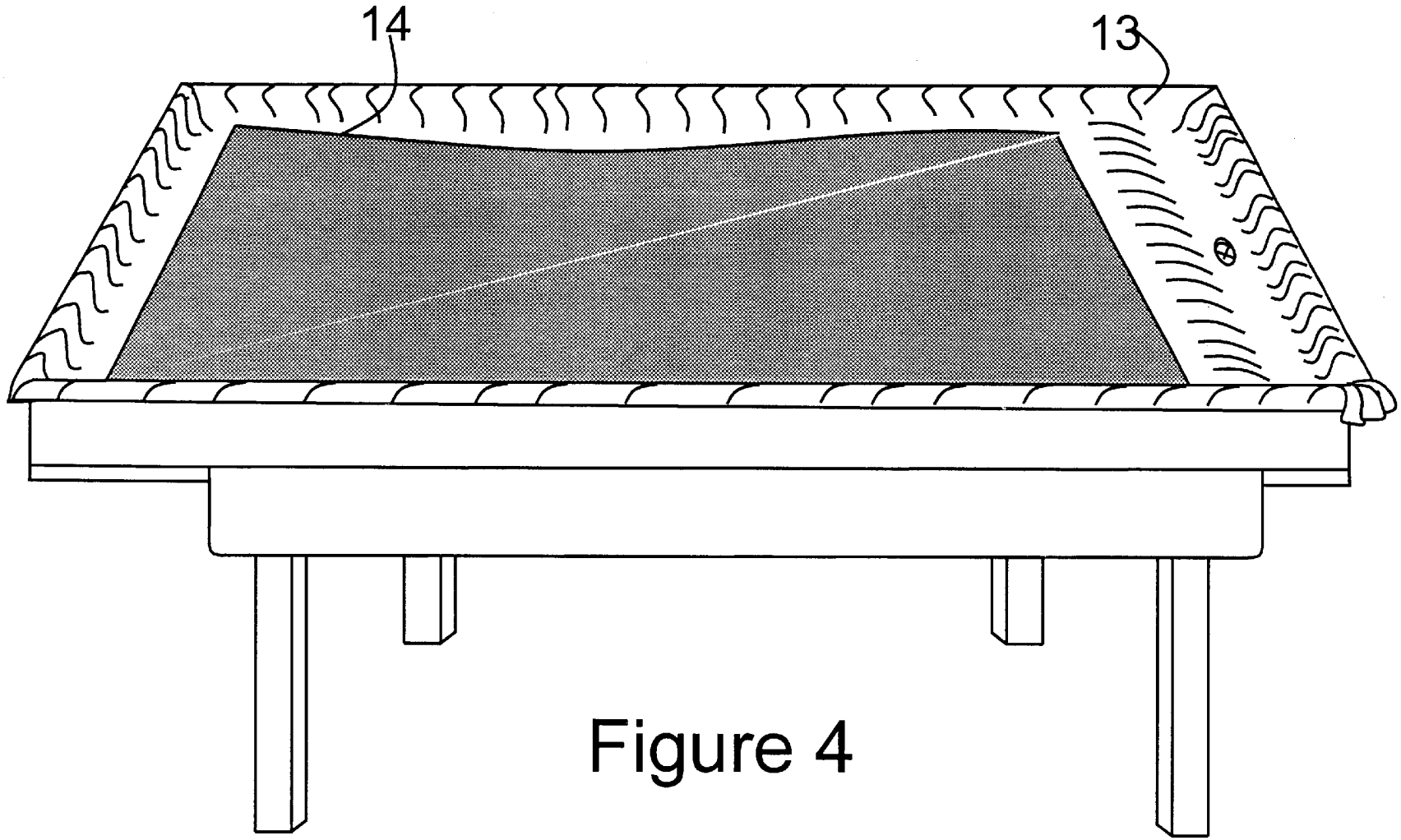
FIG. 4 is a perspective view of the assembled massage table.

As illustrated in FIG. 3, Velcro® 32 or other similar material or removable adhesive members, is preferably placed along the edge of the assembled frame 52. The vinyl sheet 13 is now placed over, and attached to, the frame 52 by matching the Velcro® on the vinyl sheet 13 with the Velcro® on the frame 52. It should be noted that the drain hole 34 in the vinyl sheet 13 must align with the drain hole 2 in the frame 52. Once the vinyl sheet 13 is secured, a piece of specialized cloth 14 is placed on the table on top of the vinyl sheet 13 before the client lies on the table. This cloth provides greater comfort than the vinyl sheet 13 and should cover the entire table to prevent leakage of the water to the frame. An example of appropriate dimensions would be 6' long and 28" wide. The most important reason for this cloth is that it can be washed in a regular washing machine with a disinfectant that provides the greatest hygienic protection for the client. The kit comes with two vinyl cloths 13 and four of the cover cloths 14. FIG. 4 shows the completed assembly.

All conventional massage tables can be adjusted to various heights in order to enable the water to drain properly. The massage table is adjusted so the head end is 2" higher than the foot end. Thus, any water that comes on the massage table will drain to the drain at the back of the massage table.

Figure 5:
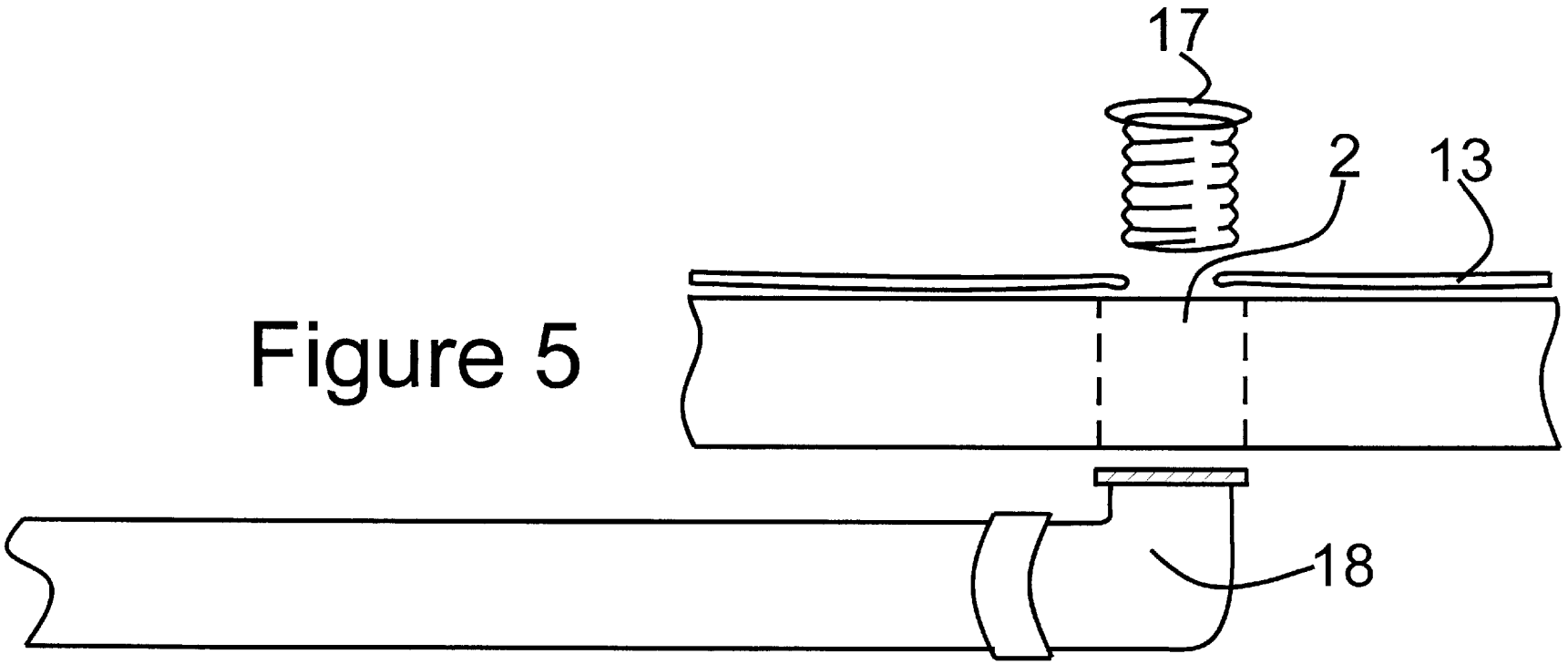
FIG. 5 is a cut away side view of the plumbing assembly.
Figure 6:
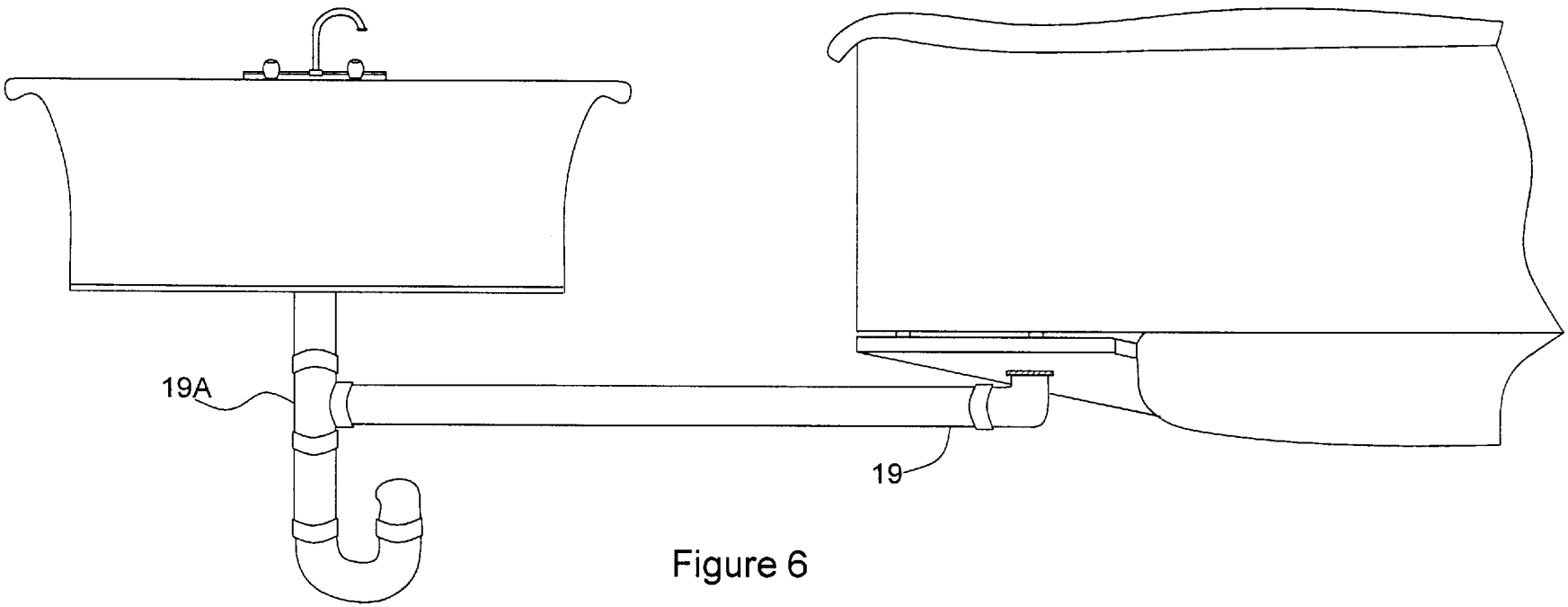
FIG. 6 is a perspective view of the disclosed table attached to a sink.
Figure 17:
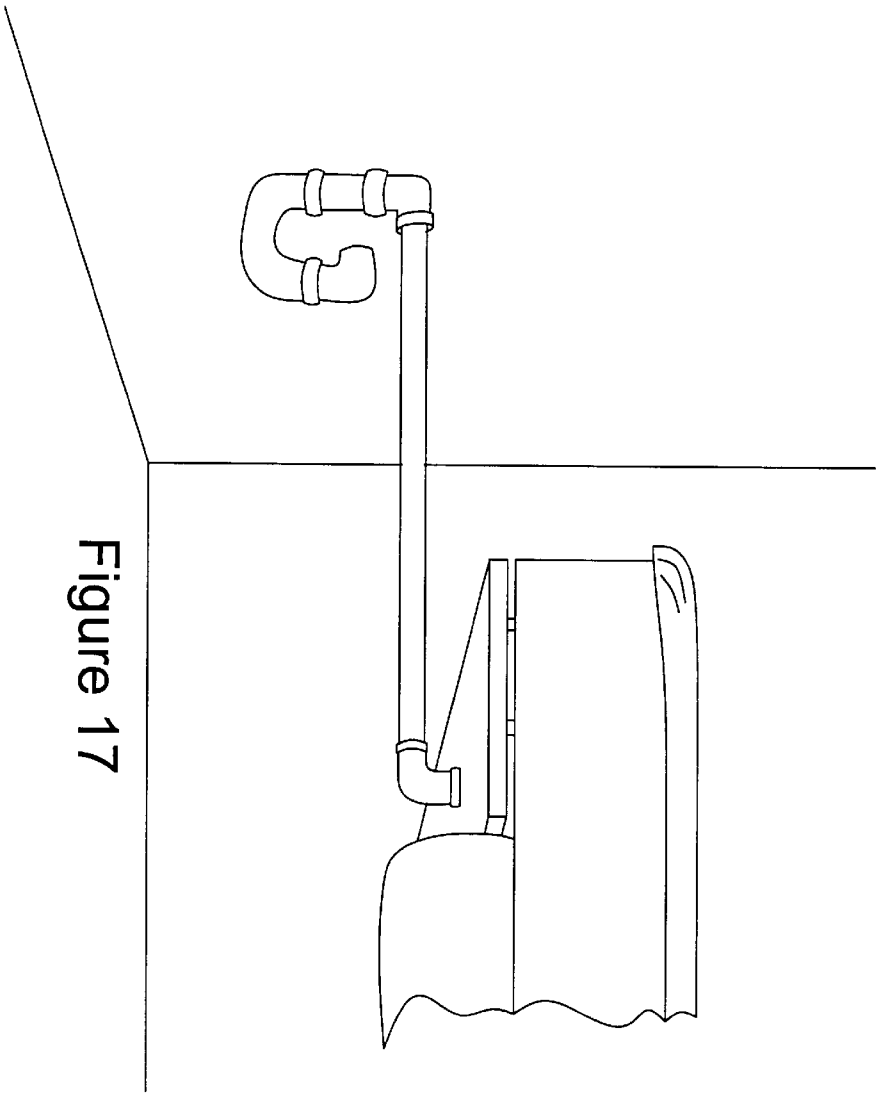
FIG. 17 is a side view of an alternate drain system for use with the disclosed system; and, FIG. 18 is a example of a system for recycling water for use during a Vichy shower treatment.

FIGS. 5 and 6 illustrate an example of the hardware applicable for use for the drain system of the disclosed invention. The 2" stainless steel drain 17 is inserted into the hole 2 in the foot brace 20. The rim of the drain 17 is positioned over the vinyl sheet 13 to seal the sheet and prevent the water from leaking. A 1½" PVC threaded elbow 18 is screwed on to the stainless steel drain and tightened to create a waterproof seal. A 1½" PVC pipe 19*a*, approximately 3' long, is now attached to the drain 18 at one end. When the PVC pipe 19 is connected under the sink to the drain, then the other end of the PVC pipe 19 is connected to the T adapter 19*a*, with sealing cap that is placed between the trap and the drain. This enables the PVC pipe to be connected when needed and removed when not needed. If the PVC pipe 19 is going to be connected to a drain at the wall, then the pipe 19 will connect to a 1½" connector above the trap as illustrated in FIG. 17.

Figure 7:
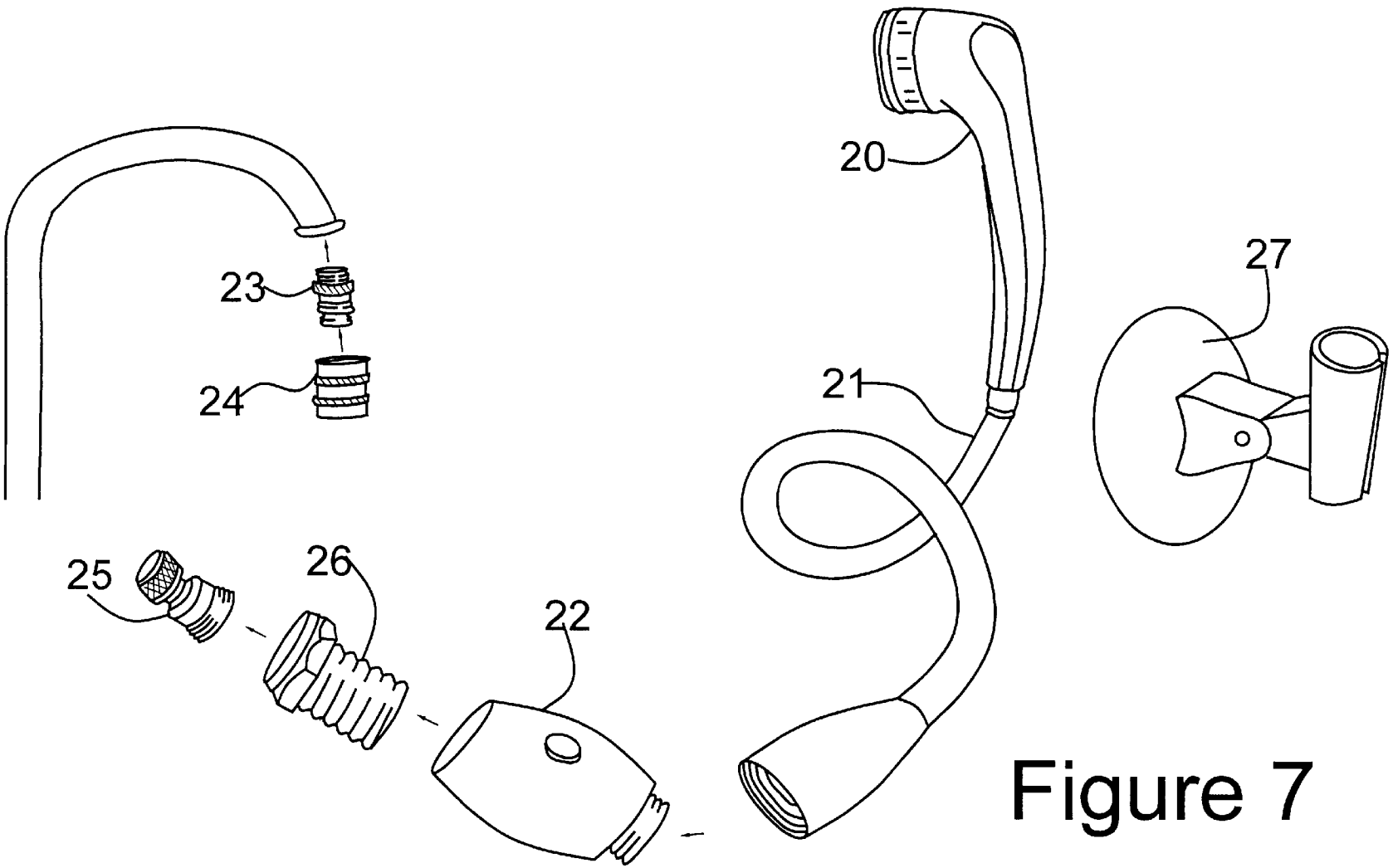
FIG. 7 is an exploded view of one embodiment of an example hose attachment for use with the disclosed table.

In one embodiment, the handheld shower system illustrated in FIG. 7 can be used with the table to bring water to the client. The handheld shower 20 should have sufficient hose 21 length to enable the entire surface of the massage table to be reached during treatments. Also, a scald protection device 22 is connected to the hose to prevent the water temperature higher than 114 degrees Fahrenheit from coming in contact with the client on the massage table. An adapter 23 is connected to the end of the faucet at the sink that has a hose fitting. A brass female quick connect 24 is attached to this fitting. The brass quick connect male 25 is connected an adapter 26 that then attaches to the handheld shower hose 21. The handheld shower can now be quickly and easily connected and disconnected to the faucet at the sink and the sink can be used as normal when the hose is not connected to it. The holder 27 can be attached to the wall or the side of the table to store the showerhead 20 when not in use.

Figure 13:
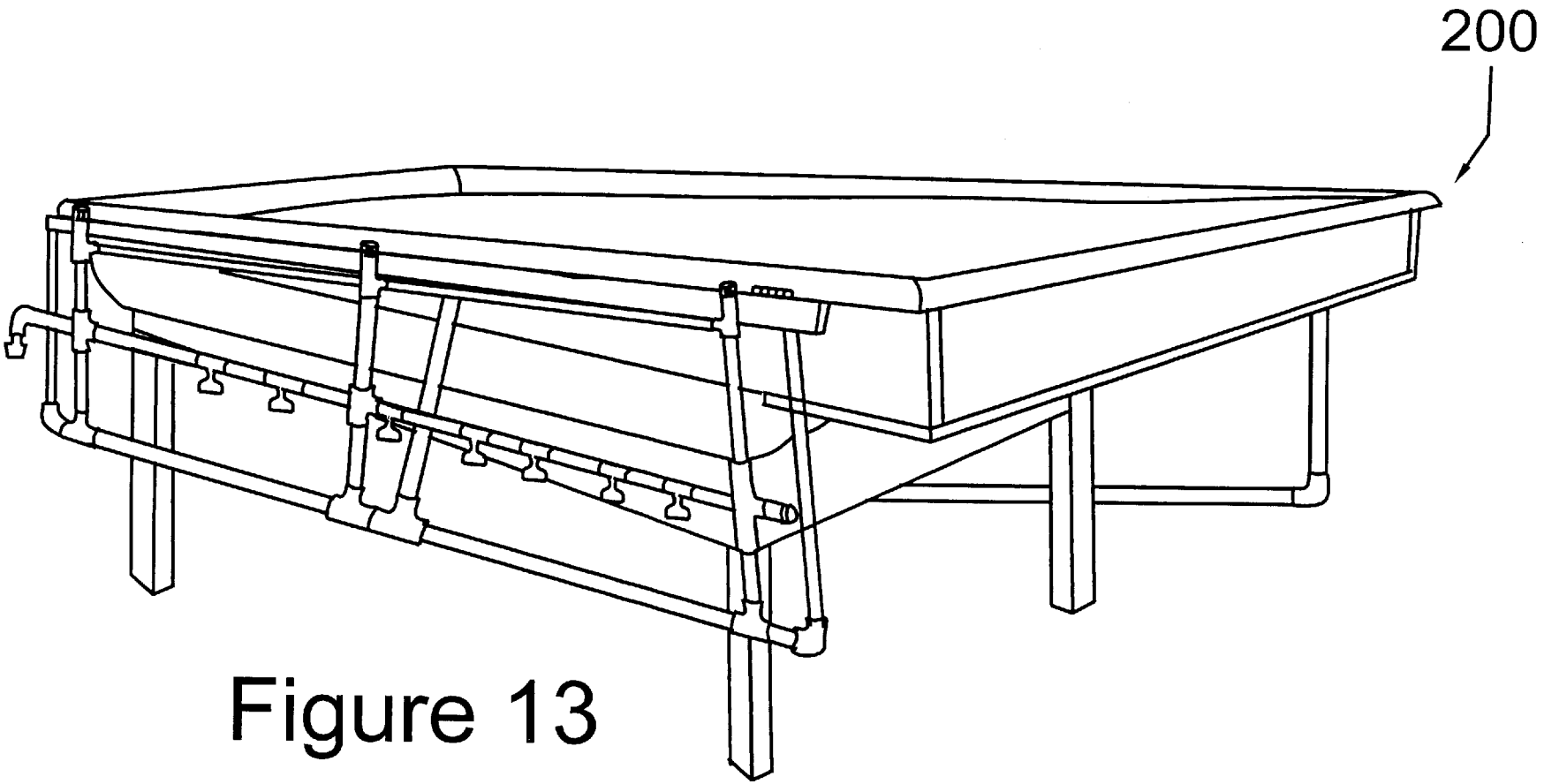
FIG. 13 is a perspective view of the assembled Vichy shower with the sides dropped.
Figure 14:
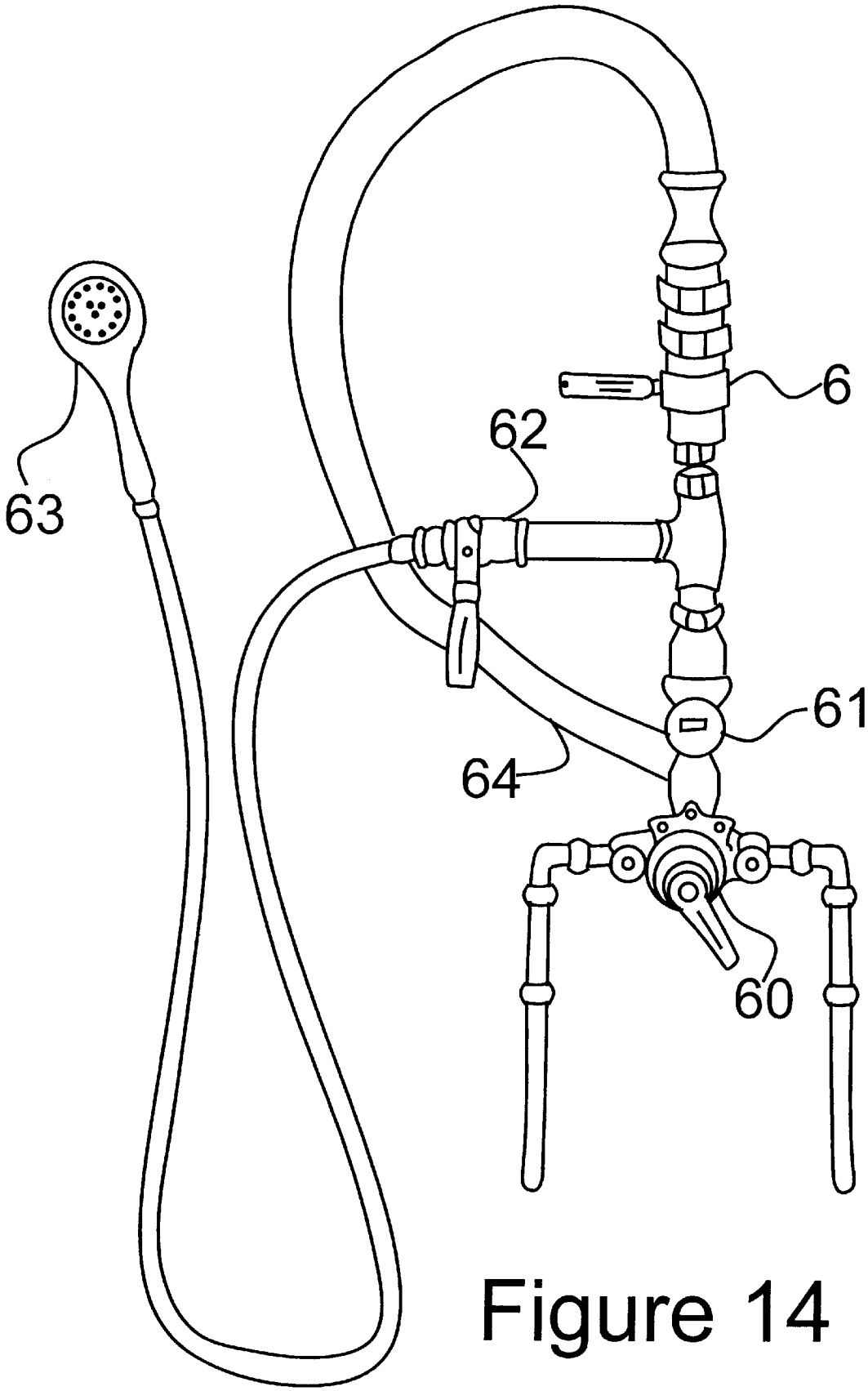
FIG. 14 is a front view of an example water connection system for use with the disclosed wet table.

In another embodiment, the disclosed table can include a hydro cover and showerheads for use alone or in conjunction with the handheld shower. In FIGS. 9–15, the disclosed table has been covered with a unique Vichy Shower system that is designed to work in conjunction with the table. The plumbing for the hydro massage system, can be any standard Vichy Shower plumbing having a mixing valve 60 that provides both scald protection and pressure balancing and enough flow rate. There is a temperature gauge 61 above the mixing valve and above that a valve 62 that allows the water to flow to the handheld shower 63. Above valve 62 is a valve 63 that allows the water to flow to the showerheads inside the hydro cover via a flexible steel hose 64. An example of a plumbing system is illustrated in FIG. 14.

The hydro cover side panels 31 and 32 are basically rectangular frames manufactured from wood, PVC or other lightweight, and preferably water resistant, material. Since the side panels 31 and 32 differ slightly they will be described separately, however it should be noted that the basic dimensions and construction are the same. The attachment base 36 can be manufactured from wood or other material that will easily receive the hinges 37*a* and 37*b*, as well as the ends of the vertical supports 35*a*, 35*b* and 35*c*. The hinges 37*a* and 37*b* enable hydro cover side panels 31 to be attached to the table frame 52. Thus, when the hydro cover system is not in use, the panels 31 and 32 hang at the side of the massage table in such a way that they do not interfere with massage therapy or other treatments. Three connectors 38*a*, 38*b*, 38*c* are provided on the horizontal support 34 that provide a method of receiving, and supporting, the top panel 140, illustrated in FIG. 10, to the side panel 31.

The attachment base 41 of the side panel 32 is hinged as noted above with hinges 42*a* and 42*b*, and receives the vertical supports 40*a*, 40*b* and 40*c*. The horizontal support 39 is dimensioned to rotatably receive the connectors 142 of the top panel 140. This is easily accomplished by dimensioning the connectors 142 to have an interior diameter slightly larger than that of the horizontal support 39, thereby enabling the top panel 140 to rotate around the horizontal support 39.

The top panel 140 has one horizontal connector pole 44 and three supporting cross poles 43*a*, 43*b*, and 43*c*. The support cross poles 43*a*, 43*b* and 43*c* are attached at one end to rotating connectors 142 and to the cross pole connectors 148 at the other end. At about the center of each of the three cross poles 43*a*, 43*b*, 43*c*, there is a shower pipe receiving hole 158 to receive the showerhead pole 45. At the end of each cross pole 43*a*, 43*b*, 43*c* there is a T shaped connector 142 that allows it to rotatably attach to the horizontal pole 39. Because the diameter of the connectors 43*a*, 43*b*, 43*c*, is greater than the diameter of the horizontal pole 39, the panel 140 can rotate when disconnected from panel 31 and fold at the side of the massage table adjacent to the panel 32.

The showerhead pipe 45, holding the showerheads 245, is constructed of PVC, CPVC, copper pipe or similar material. The showerheads 245 can be connected to the pipe 45 in any variety of positions. The connectors between the showerheads and the pipe 45 allow for the rotation of the showerheads 245, thereby enabling the showerheads to lie in a vertical position when folded, as illustrated in FIG. 13. In the illustrated example, seven showerheads 245 are connected to the pipe 45, although any number can be used. The positioning of several showerheads in a straight line above a spa customer lying on a treatment table is termed a "Vichy shower" in the spa industry. However, it is possible to create various patterns of showerheads over the treatment table. It would be possible to have two or even three pipes with different numbers of showerheads inside to create different combinations and patterns of water showering on to the client's body. At one end of the pipe 45, there is a brass quick connect male ½" piece 46 that will allow the pipe to be connected to a water source while the opposite end is plugged to force the water to exit through the showerheads 245.

In one construction format, the sides panels 31 and 32 are manufactured from PVC tubing, preferably having a diameter of about ½". The attachment base 36 is a wood that has been drilled to receive the vertical supports 35*a*, 35*b*, and 35*c* and has been fitted with the hinges 37*a* and 37*b*. The vertical supports 35*a* and 35*c* are connected to the horizontal support 34 by elbows 132. The center vertical support 35*b* is connected to the horizontal support 34 through use of a T 134. Connector Ts 38*a*, 38*b* and 38*c* are placed along the horizontal support 34 to receive the top panel 140. The top panel 140 has one pole 44 75 inches long with three 20 inch long cross poles 43*a*, 43*b*, 43*c* attached to the pole 44. At the center of each of the three cross poles 43*a*, 43*b*, 43*c*, there is a ¾" diameter hole that will allow a ½" diameter pipe with showerheads 245 to connect through it. At the end of each cross pole 43*a*, 43*b*, 43*c* there is a T shaped connector with a ¾" diameter hole that allows it to attach to pole 39. Because the diameter of the connectors 43*a*, 43*b*, 43*c*, is greater than the diameter of the pole 45, the panel 33 can rotate when disconnected from panel 31 and fold at the side of the massage table with panel 32.

To assemble the tent structure 225, the panel 32 is first brought up into position and then the second panel 31 brought into position. The top panel is then placed over and secured, forming the tent structure 225.

Figure 11:
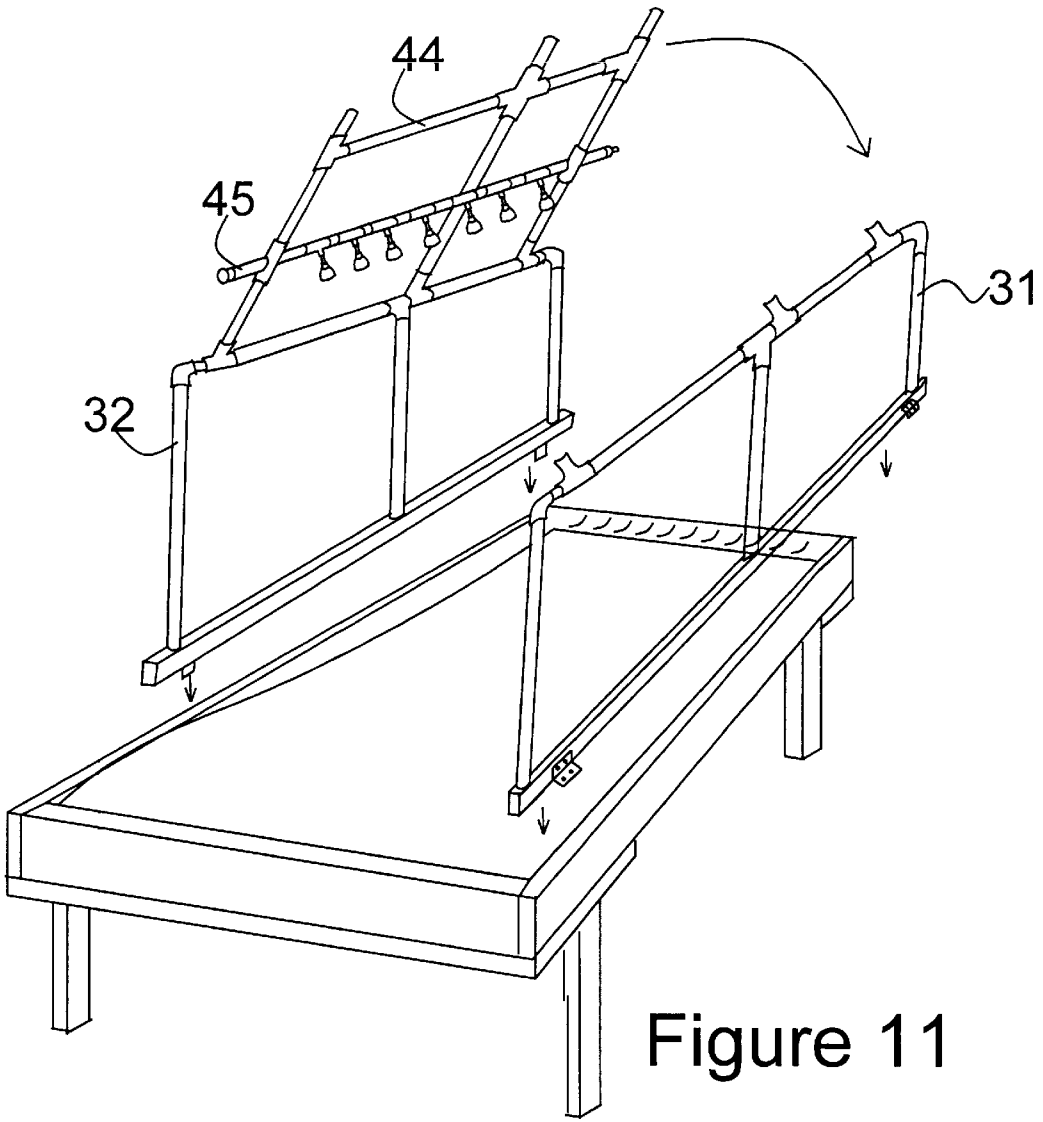
FIG. 11 is an exploded perspective view of the Vichy shower prior to assembly.
Figure 12:
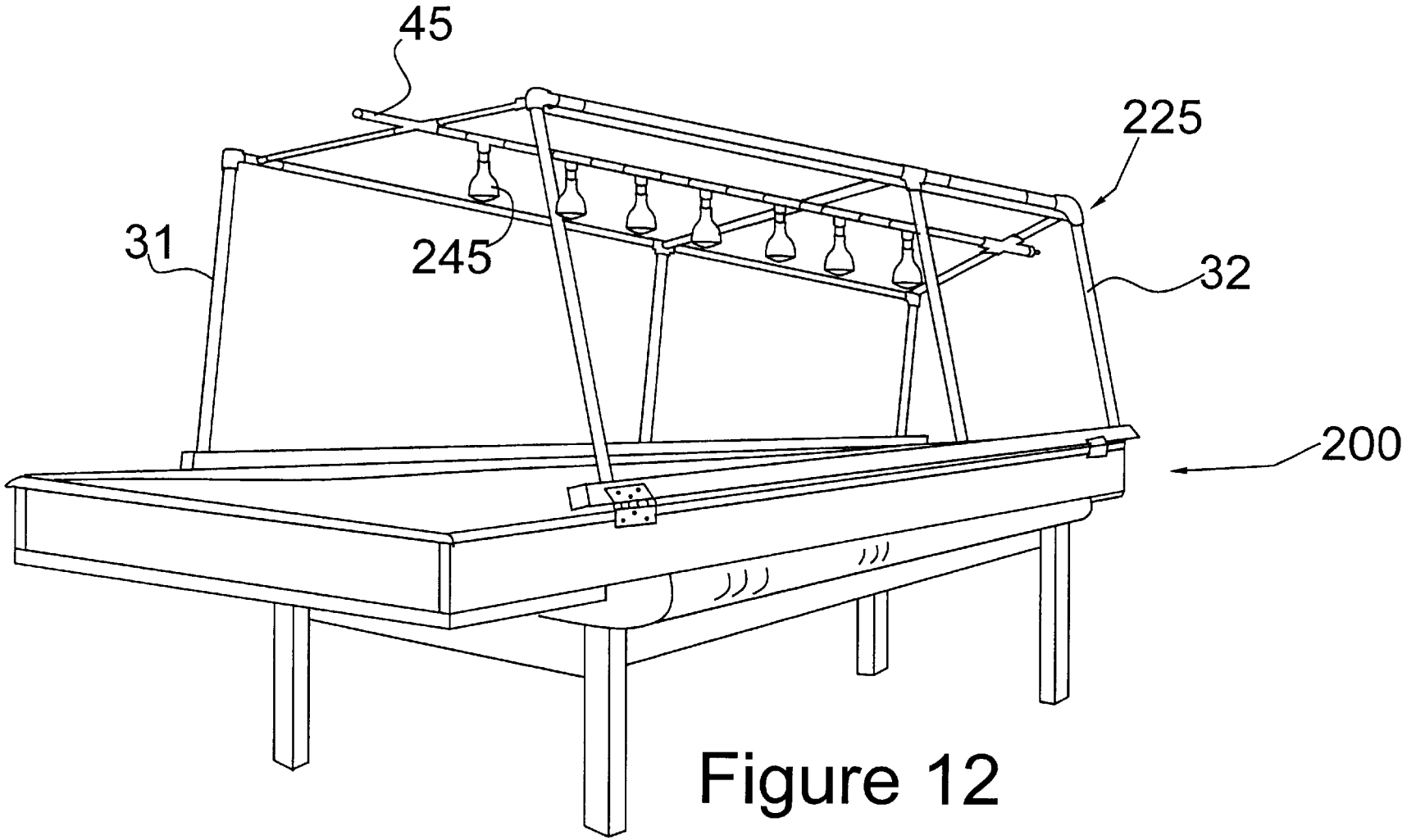
FIG. 12 is a perspective view of the assembled Vichy shower frame.
Figure 16:
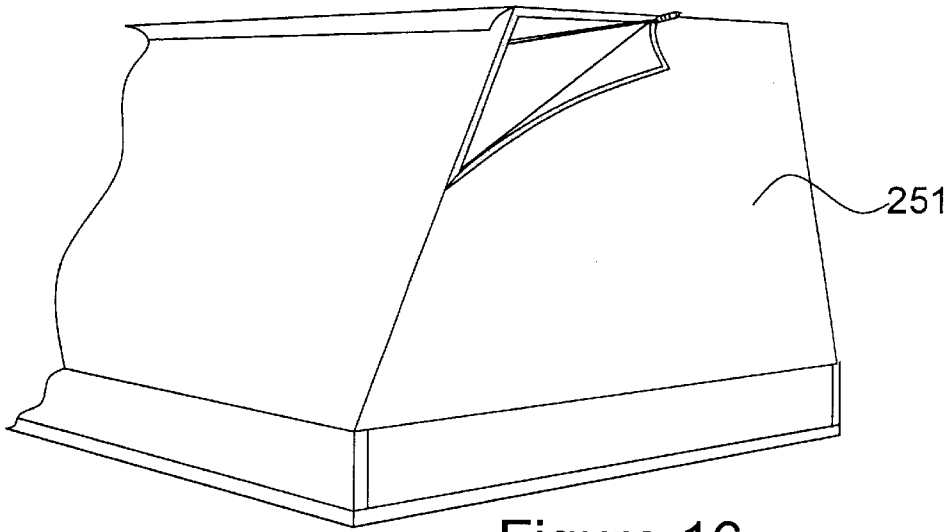
FIG. 16 is a perspective view of the back of the covered Vichy shower.
Figure 15:
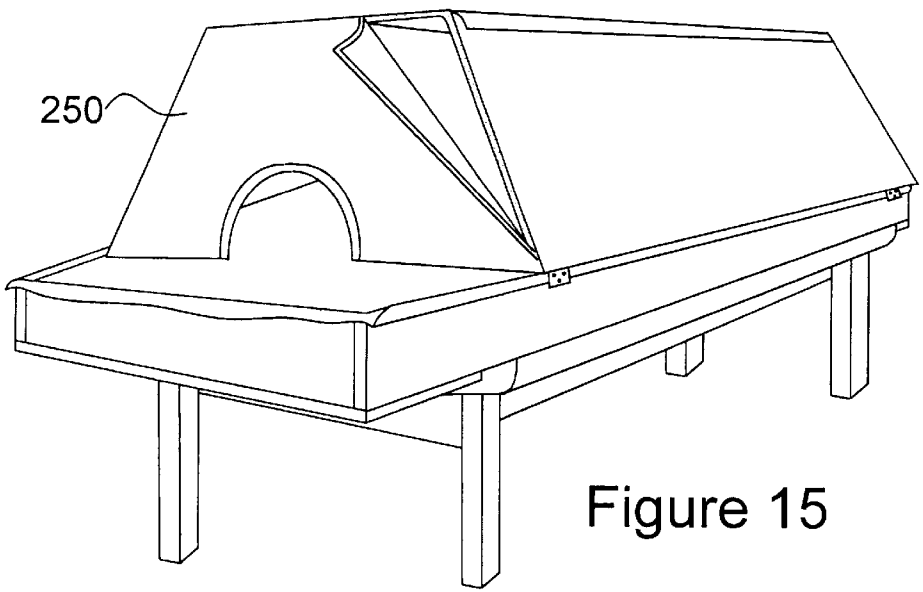
FIG. 15 is a perspective view of the front of the assembled Vichy shower with cover.

The complete assembly of panels 31 and 32, their attachment to the wooden frame and to each other, is shown in FIGS. 11 and 12. The tent structure 225 formed by the panels 31, 32 and 45 is then covered with a waterproof cloth 250, such as waterproofed nylon. The fabric 250 is attached to the tent structure 225 panels through the use of Velcro®, or other materials, affixed to the fabric 250 or, alternatively to the tent structure 225. When the tent structure 225 is covered with the fabric 250, the water from the showerheads 245 will drain inside of the hydro cover and not on the floor. A front piece of waterproof cloth 251 will be attached at the head end using Velcro® to prevent water from splashing out the head end when in use. A piece of waterproof cloth 251 (FIG. 16) is attached at the back end of the hydro cover 250 to prevent water from splashing out at the back end.

Although the foregoing tent structure is disclosed as being used as a shower, it should also be noted that lamps, fans or other appliances could also be used, depending upon end use.

Figure 18:
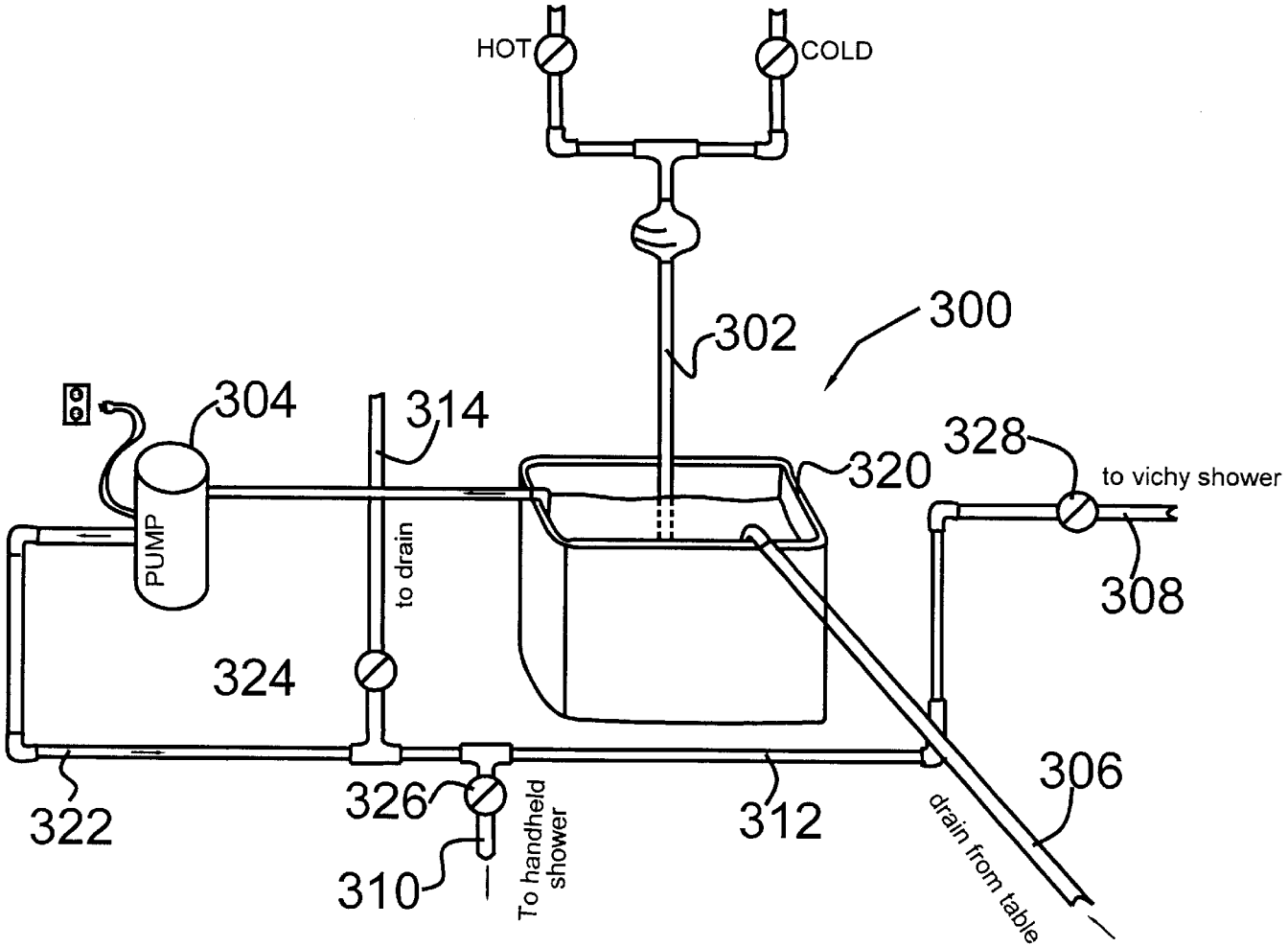

It is also possible to use as a plumbing system to bring water to the handheld shower and showerheads a re-circulating pump to re-circulate heated water through the showerheads and handheld shower to significantly reduce the amount of water used. One example of a re-circulating system is illustrated in FIG. 18 wherein the water is fed into the container 320 from a standard hot/cold plumbing 302. The water is pumped from the container 320, into the piping system 322, through use of a pump304. The piping system is provided with a number of valves 324, 326 and 328 that serve to direct the water. The user has the option of directing the water to either the handheld shower 310 or to the Vichy shower 308 by opening or closing the respective valves 326 or 328. The water is drained from the table back into the container 320 through the table drain 306. Once the user has completed the treatment, the valve 326 to the handheld shower 310 and the valve 328 to the Vichy shower 308 are turned off and the drain valve 324 opened. The water is then pumped to the drain until the container 320 is emptied.

What is claimed is:

1. A system to enable the removable conversion of a massage table to a hydrotherapy wet-table, said system having:

a frame, said frame being dimensioned to have an interior perimeter slightly greater than said massage table exterior perimeter and having:

a foot panel, said foot panel having a foot brace, said foot brace being substantially horizontal, and a foot upright, said foot upright being affixed to said foot brace at approximately a right angle and a pair of prongs, said prongs extending from said foot brace and dimensioned to be received by holes within a first end of said massage table;

a head panel, said head panel having a head brace, said head brace being substantially horizontal and a head upright, said head upright affixed to said head brace at approximately a right angle;

a head support, said head support being a support panel and a pair of prongs, said pair of prongs extending from said head support and dimensioned to be received by holes within a second end of said massage table and said support panel providing support for said head panel;

a pair of sidepieces, each of said sidepieces extending from said foot upright to said head upright and affixed thereto;

a waterproof sheet, said waterproof sheet being dimensioned to cover said massage table and said frame;

wherein said frame is supported by, and surrounds, said massage table to retain water within said waterproof sheet covering said frame.

2. The system of claim 1 wherein said foot brace has a length greater than said foot upright thereby enabling said sidepiece to rest on said foot brace.

3. The system of claim 1 further comprising a drain hole within said foot brace, said drain hole being connected to a drain system to remove water from said wet-table.

4. The system of claim 3 wherein said drain system is a water recycling system, said water recycling system comprising a pump, a hand held shower and a retaining vessel, said retaining vessel receiving water from said wet-table and said pump pumping water from said retaining vessel to said hand held shower, thereby circulating said water.

5. The system of claim 4 further comprising a heater within said retaining vessel, said heater maintaining said water at a predetermined temperature.

6. The system of claim 1 wherein each of said frame and said waterproof sheet further comprise interacting affixing means, said affixing means enabling said waterproof sheet to be attached to and removed from said frame thereby preventing said waterproof sheet from moving during use.

7. The system of claim 1 further comprising a head hole, said head hole extending through said head brace and aligning with a head hole in said massage table to enable a user to lie face down.

8. The system of claim 1 wherein each of said pair of sidepieces are at least two substantially equal lengths hinged together, thereby enabling each of said pair of sidepieces to fold.

9. The system of claim 1 further comprising a cover cloth, said cover cloth being placed over said waterproof liner to provide for user comfort.

10. The system of claim 1 wherein said head support angles said frame to cause water to run to the opposite end of said frame from said head support.

11. The system of claim 1 further comprising a U-shaped frame, said U-shaped frame having a length and a pair of ends:

a pair of frame walls, a first of said frame walls forming said length and having:

a. an attachment base, said attachment base being less than the length of said sidepieces and being rotatably attached to said sidepieces;

b. a horizontal support, said horizontal support having a length about equal to said attachment base;

c. at least two vertical supports, each of said at least two vertical supports having a first end attached to said attachment base and a second end attached to said horizontal support;

d. frame receiving members, said frame receiving members being positioned along said horizontal support;

a second of said pair of frame walls having:

a. an attachment base, said attachment base being the length of said frame wall and being rotatably attached to said sidepieces;

b. a horizontal support, said horizontal support having a length about equal to said attachment base;

c. at least two vertical supports, each of said at least two vertical supports having a first end attached to said attachment base and a second end attached to said horizontal support;

a top frame, said top frame having:

at least a pair of supports, each of said at least a pair of supports having rotatable attachment members at a first end and interlocking members at a second end, said interlocking members being positioned to be received by said frame receiving members;

a brace, said brace extending between said at least a pair of supports proximate said interlocking members;

an appliance bar, said appliance bar extending between said at least a pair of supports to enable at least one appliance to be positioned over a user.

12. The system of claim 11 wherein one end of said appliance bar is connected to a water source and sealed at a second end, said appliance bar having multiple showerheads.

13. The system of claim 12 further comprising a waterproof covering, said waterproof covering said pair of frame walls and said top frame.

14. The system of claim 13 further comprising waterproof end coverings, said waterproof end coverings covering said ends.

15. The system of claim 14 further comprising a U-shaped frame, said U-shaped frame having a length and a pair of ends:

a pair of frame walls, a first of said frame walls forming said length and having:

a. an attachment base, said attachment base being less than the length of said sidepieces and being rotatably attached to said sidepieces;

b. a horizontal support, said horizontal support having a length about equal to said attachment base;

c. at least two vertical supports, each of said at least two vertical supports having a first end attached to said attachment base and a second end attached to said horizontal support;

d. shower frame receiving members, said shower frame receiving members being positioned along said horizontal support;

a second of said pair of frame walls having:

e. an attachment base, said attachment base being the length of said frame wall and being rotatably attached to said sidepieces;

f. a horizontal support, said horizontal support having a length about equal to said attachment base;

g. at least two vertical supports, each of said at least two vertical supports having a first end attached to said attachment base and a second end attached to said horizontal support;

a shower frame, said shower frame having:

at least a pair of supports, each of said at least a pair of supports having rotatable attachment members at a first end and interlocking members, said interlocking members being positioned to be received by said shower frame receiving members;

a brace, said brace extending between said at least a pair of supports proximate said interlocking members;

a shower head bar, said shower head bar extending between said at least a pair of supports and being connected at one end to a water source and sealed at a second end, said shower head bar having multiple showerheads;

a waterproof covering, said waterproof covering said pair of frame walls and said shower frame to form a tent over a user; and waterproof end coverings, said waterproof end coverings covering said ends and preventing water from leaving said tent.

16. The system of claim 11 wherein said appliance bar carries at least one lamp.

17. A system to enable the conversion of a massage table to a hydrotherapy wet-table, said system having:

a frame, said frame being dimension to have an interior perimeter slightly greater than said massage table exterior perimeter and having:

a foot panel, said foot panel having a horizontal foot brace, said foot brace having a first length, and a foot upright, said foot upright having a second length and being affixed to said foot brace at approximately a right angle and a pair of prongs, said prongs extending horizontally from said foot brace and dimensioned to be received by holes within a first end of said massage table, said foot upright second length being less than said foot brace first length;

a drain hole, said drain hole being within said foot brace and connected to a drain system to remove water from said wet-table.

a head panel, said head panel having a horizontal head brace, said head brace having a first length and a head hole extending through said head brace, said head hole being aligned with a head hole in said massage table to enable a user to lie face down, and a head upright, said head upright having a second length being affixed to said head brace at approximately a right angle;

a head support, said head support being a support panel and a pair of prongs, said pair of prongs extending from said head support and dimensioned to be received by holes within a second end of said massage table;

a pair of sidepieces, each of said sidepieces extending from said foot upright to said head upright and affixed thereto;

a waterproof sheet, said waterproof sheet being dimensioned to cover said massage table and said frame;

interacting affixing means, said affixing means preventing said waterproof sheet from moving during use and being attached to each of said frame and said waterproof sheet to enable said waterproof sheet to be attached to and removed from said frame;

a cover cloth, said cover cloth being placed over said waterproof sheet to provide for user comfort, wherein said frame is supported by, and surrounds, said massage table to retain water within said frame.

18. The system of claim 17 wherein said drain system is a water recycling system, said water recycling system comprising a pump, a hand held shower, a heater, said heater maintaining said water at a predetermined temperature, and a retaining vessel, said retaining vessel receiving water from said wet-table and said pump pumping water from said retaining vessel to said hand held shower, thereby circulating said water.

* * * * *